United States Patent [19]

Christensen

[11] 4,052,797

[45] Oct. 11, 1977

[54] ROTARY DRUM PLENUM SEAL

[75] Inventor: Charles W. Christensen, Cedar Rapids, Iowa

[73] Assignee: Raytheon Company, Lexington, Mass.

[21] Appl. No.: 673,035

[22] Filed: Apr. 2, 1976

[51] Int. Cl.[2] ..... F26B 25/00

[52] U.S. Cl. ..... 34/242; 432/242

[58] Field of Search ..... 34/15, 242; 68/5 E; 432/242; 277/81

[56] References Cited

U.S. PATENT DOCUMENTS

| | | | |
|---|---|---|---|
| 3,383,115 | 5/1968 | Eckley et al. | 34/242 |
| 3,785,063 | 1/1974 | Bishop | 34/128 |
| 3,815,257 | 6/1974 | Freze | 34/129 |
| 3,940,239 | 2/1976 | Rossi et al. | 34/242 |

*Primary Examiner*—Kenneth W. Sprague
*Assistant Examiner*—James C. Yeung
*Attorney, Agent, or Firm*—H. A. Murphy; J. D. Pannone; J. T. Meaney

[57] ABSTRACT

An air seal having a flexible annular seal which fits around a cylindrical rotatable member and a flexible marginal portion which slidably interfits within an opening into a substantially closed chamber whereby both rotation and pivotal movement of the member is permitted without allowing flow of an substantial amount of air between the member and chamber.

4 Claims, 6 Drawing Figures

ROTARY DRUM PLENUM SEAL

BACKGROUND OF THE INVENTION

In apparatus such as waste handling or resource recovery systems it is well known that a drum which is rotatable about its longitudinal axis may be used to separate materials into light and heavy fractions. This is done by tilting the drum's axis to a selected angle and depositing materials of mixed weights in the interior of the drum as it is being rotated. Simultaneously therewith a stream of air at relatively high velocity is made to flow upwardly through the drum. Heavy materials will proceed to make their way downwardly and out the lower end of the drum while light materials will be entrained in the air stream and carried out the upper end of the drum.

Such apparatus is fully shown and described in U.S. patent application Ser. No. 580, 372, filed May 22, 1975, and owned by the assignee of the present invention.

In such apparatus the light materials which are carried out the upper end of the drum enter a plenum or other collector. To achieve this the upper end of the drum is inserted into the plenum through an opening in a side wall thereof. However, the drum cannot be attached to the plenum wall in a tight fit because it must be permitted to rotate and to be angled as desired.

This, then, poses severe problems since it is also necessary to prevent any substantial amounts of air from passing between the drum and plenum wall. To provide the air stream within the drum for entrainment of light fractions, a fan or blower is mounted in a position to draw air upwardly through the drum and sequentially through the plenum. It will be apparent that if an air seal of some sort is not provided between the rotary drum and plenum wall, air will be drawn through this space and will considerably affect the flow of air through the drum. This could render the system unworkable or could require the use of an oversized fan system.

SUMMARY OF THE INVENTION

To overcome the foregoing and other objections to prior art systems of this character there is provided, in accordance with this invention, an air seal between the rotary drum and plenum wall which prevents any substantial amounts of air from passing through the space between the drum and wall. The seal includes a portion of the wall which encircles the opening and extends outwardly therefrom to encircle the adjacent upper end of the drum. A seal member is located in encircling relation to the drum and has a flexible annular portion which snugly interfits with the outer surface of the drum and within which the drum frictionally rotates.

The periphery of the seal includes a flexible member which is engaged constantly with the inner surfaces of the extension on the plenum wall. The seal is fixedly connected to the support or base on which the drum is mounted and which is pivotally adjustable up or down with the drum to locate the drum in the desired angular position. Such adjustment is about an axis adjacent and slightly below the upper end of the drum, and during such adjustment the flexible peripheral member on the seal is retained in a constant sliding engagement with the wall extension.

Thus, the seal, which is not to be considered an hermetic seal, is constantly located in a position to prevent substantial amounts of air from passing between the drum and plenum wall while the drum is being rotated and at any selected angular position of the drum with respect to the plenum.

BRIEF DESCRIPTION OF THE DRAWINGS

Other objectives and advantages of the invention will become apparent from the following description taken in connection with the accompanying drawings, wherein.

DESCRIPTION OF THE PREFERRED EMBODIMENT

Figure 1:
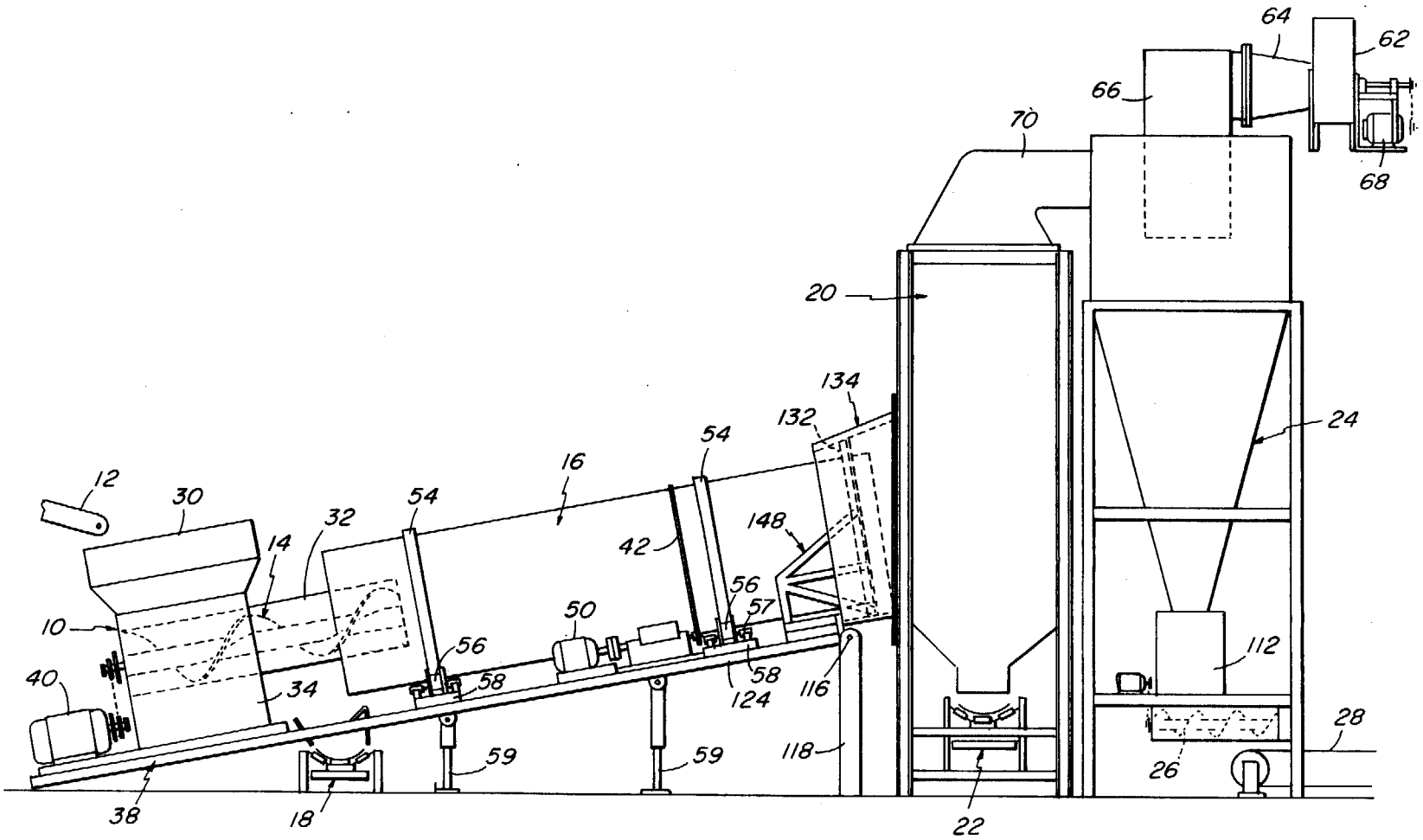
FIG. 1 is an elevational view of a resource recovery system embodying the invention.

Referring more particularly to the drawings wherein like characters of reference designate like parts throughout the several views, there is shown in FIG. 1, as an example of one particularly useful application of a seal embodying the invention, a waste separation and resource recovery system of the type generally shown and described in aforementioned application Ser. No. 580,373.

A feed hopper 10 receives shredded raw waste material from an adjacent conveyor 12 and directs it to a screw feed 14 which deposits it within a rotatable air drum classifier 16. The drum classifier separates the raw materials into light and heavy materials in the known fashion of devices of this character. The drum is angled at a selected inclination, such as 10° for example, and air is caused to flow through it at high velocity. As raw materials drop from the end of the screw feed onto the bottom of the drum wall, the heavy materials will be rotated upwardly by vanes (not shown) within the drum to a point where they will fall to a lower point in the drum. This action is repeated until eventually the heavy materials fall out of the lower end of the drum onto a conveyor 18 which will carry them away for further processing or disposal.

The light materials will be entrained within the high velocity air stream and will be carried out the upper end of the drum 16 into a plenum chamber 20. In the plenum chamber 20 these light materials are further separated into light and medium fractions by controlling the velocity of the air stream within the chamber 20. The air stream from the drum 16 enters the plenum chamber 20 at a point in the lower region thereof and exits at the top. Thus, by controlling the size of the chamber, and thus the velocity of the air rising within it, the heavier of the materials entrained within the air stream may be permitted to fall by gravity to the bottom of the chamber for removal by suitable means such as a conveyor 22 for eventual reprocessing or disposal such as by incineration or other means.

The lighter fractions will continue to be entrained within the air stream and will be carried into a cyclone collector 24. Such light fractions may serve many purposes and have been found particularly suitable for use as a fuel. They are removed from the cyclone by a screw feed 26 to a suitable conveyor 28 which will then carry them to a selected supply or disposal area.

The feed hopper 10 is provided with a bucket portion 30 at its upper end into which the raw materials are deposited by the conveyor 12. These raw materials have previously been shredded so that they comprise a mixture of raw material elements not exceeding about 12 inches in size, for example.

A feed duct or conduit 32 extends from the base 34 of the feed hopper 10 into the adjacent end of the drum 16. Within the duct 32 is the screw 14, one end of which is mounted in the hopper base 34 to receive the raw materials from bucket 30. Hopper 10 is mounted upon a suitable base or platform 38 which also supports the drum 16, as will be described.

Screw 14 is driven by a motor and chain drive 40 so that the raw materials will be moved along duct 32 into the drum interior.

At a point midway of its length the outer surface of the drum is provided with a fixed circumferential sprocket wheel 42 which meshes with a chain link drive belt 44 carried by a pair of smaller sprocket wheels 46. One sprocket wheel 46 is rotatably mounted on one end of a reduction gear box 48 which is interconnected with drive motor 50 on platform 38 whereby rotation of the drum is accomplished.

The platform 38 and consequently the drum 16 thereon is angled to a selected inclination, such as 10° for example. To prevent longitudinal displacement of the drum there are provided two fixed restraining rings or collars 54 extending around the circumference of the drum and spaced from respective ends thereof.Each ring 54 engages a respective roller 56 mounted by suitable bearings 57 in a support 58 carried by the platform 38. Flanges on the sides of the rollers 56 prevent longitudinal movement of the drum as it is rotated.

As shown in FIG. 1, the angle of inclination of the drum 16 may be altered to vary the velocity of the air flowing through the drum and to thereby vary the ratio of lights to heavies being separated within the drum. Such changing of the angle of inclination of the drum may be accomplished by means of jackposts 59, for example, which re suitably mounted beneath the drum 16 and attached to it as by clevis devices 61.

The upper end of the drum extends through an inlet opening in the adjacent side wall of the plenum chamber 20. It is important, however, to retain the upper end of the drum constantly within the opening in the plenum wall. Therefore, the upper end of the drum is pivoted as by a suitable bearing arrangement 116 carried preferably by the adjacent upper end of the platform 38 and rotatably mounted at the upper ends of fixed supports or standards 118. Thus, the platform 38 can be raised and lowered by manipulation of the jackposts 59, causing the drum to be angled about the axis of the pivotal connection 116.

Figure 2:
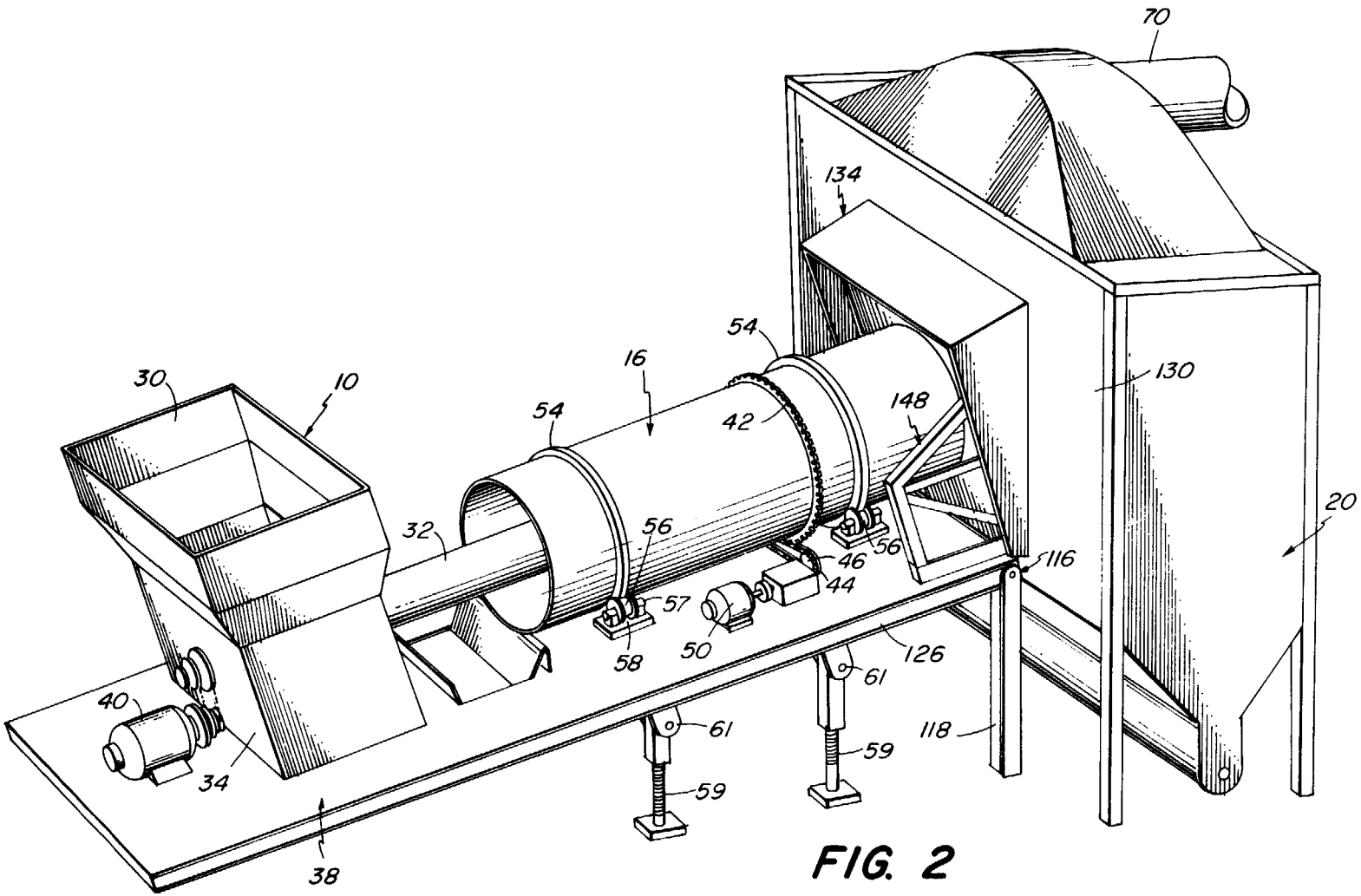
FIG. 2 is an isometric view of a portion of the system shown in FIG. 1.
Figure 6:
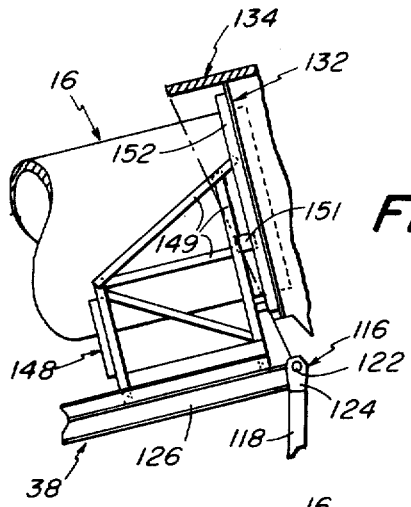
FIG. 6 is an elevational view of the framework interconnecting the drum-supporting base and the seal.
Figure 5:
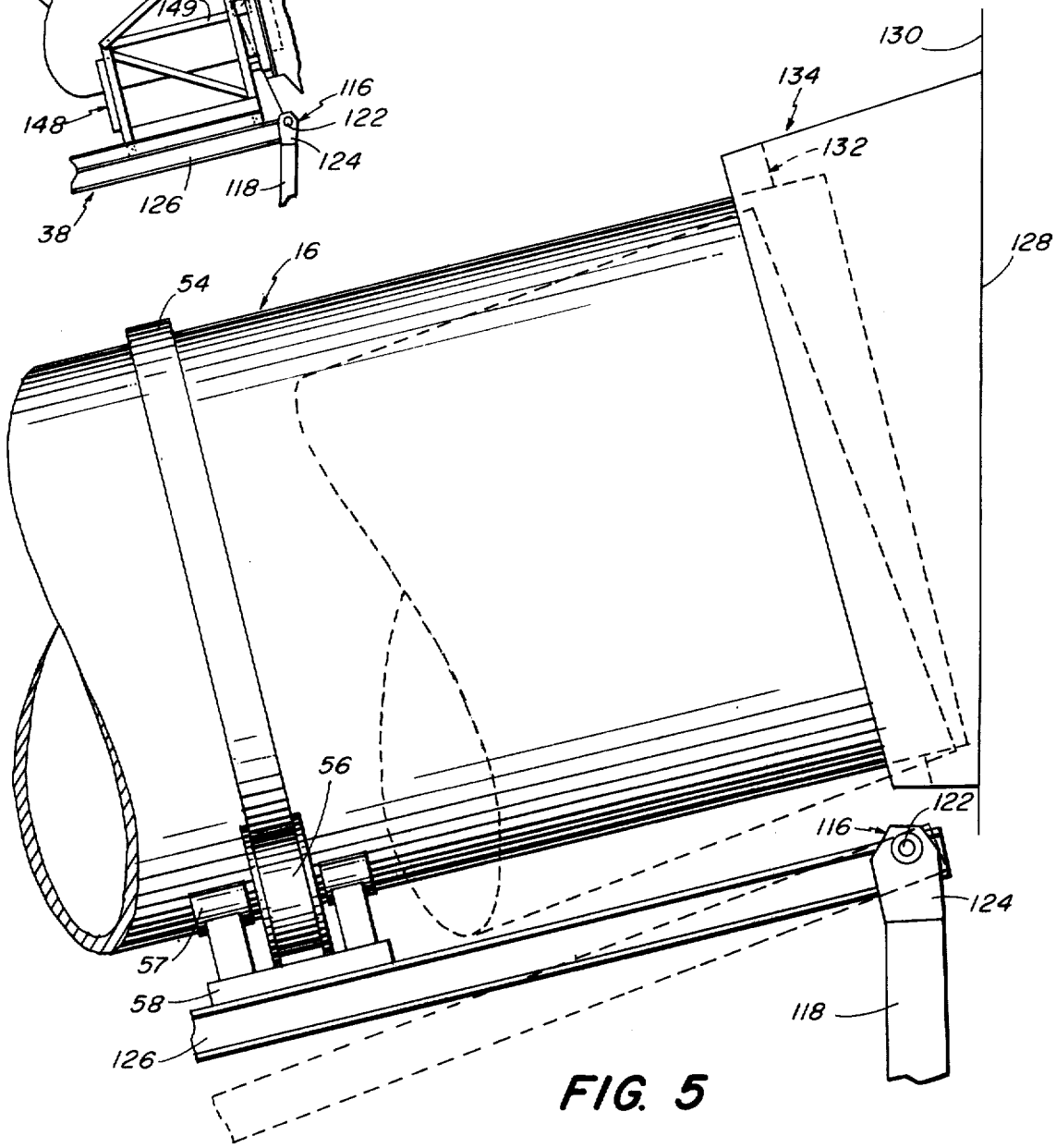
FIG. 5 is a fragmentary elevational view of a portion of the rotary drum and adjacent parts of the system, showing particularly the relationship of these portions of the system at various angular positions of the drum.

The pivotal connection 116 may take any suitable form which is sufficiently rugged enough to support the heavy apparatus. In FIGS. 1, 2 and 6, each standard or post 118 carries at its upper end a bearing plate 124 which rotatably receives a pivot member 122 extending from the adjacent side of and fixed in an I-beam 126 or the like which constitutes a side portion of the platform or base 38. The base 38 may also be constructed in any suitable manner such as from rigid I-beams, channel irons and angle irons, or may comprise a solid sheet-like platform on I-beams as shown in FIG. 2.

Air at high velocity is forced through the drum 16 by means of a fan or blower 62 mounted in any suitable fixed location and operatively connected to the outer end of exhaust duct 64 at the upper end of the cyclone 24 by interconnecting duct 66. The blower is operated by a motor 68 through suitable driving means so as to rotate in a manner which will suction air upwardly out of the cyclone. Such air is initially drawn into the cyclone through duct 70 from the upper end of the plenum chamber 20.

Thus, air is also drawn upwardly out of the plenum chamber 20 and simultaneously into the plenum chamber from the rotary drum 16.

In the construction and operation of an air drum classifier of this sort, there is provided a series of spaced longitudinally extending ribs or vanes (not shown) on the inner wall of the drum 16 which function as lifters to raise the heavy materials, as the drum rotates, to a height from which they may be dropped again to the bottom of the drum. It will be understood that since the drum is inclined the heavy materials will be dropped nearer the lower end of the drum. Therefore, continued rotation of the drum and lifting and dropping of the heavy materials will move the heavy materials toward the lower end of the drum until they eventually fall out of the drum onto conveyor 18. A considerable amount of the light materials emanating from the end portion of the feed duct 32 will be entrained in the high velocity air stream as the raw materials drop from the duct onto the drum wall and will be drawn into the plenum chamber 20. However, some small amounts of light materials will be mixed with the heavy materials falling onto the drum wall. These light materials will, of course, also be raised by the lifters and will eventually be removed by the air stream during the repetitive drops as the drum is rotated. Consequently substantially all of the light materials will eventually be separated and drawn into the plenum chamber 20.

In the plenum chamber 20 the heaviest of the light materials are separated by controlling the velocity of the air flowing upwardly through the plenum chamber. This is achieved by regulation of the width of the chamber. Thus, with a narrow chamber, air velocity is increased and more light materials will be allowed to pass on to the cyclones. By widening the chamber, air velocity is decreased and thus a greater quantity of the heaviest of the light materials will consequently fall to the bottom of the chamber. Thus, the light materials from the rotary drum 16 are separated in the plenum chamber 20 into two separate fractions, and the ratio of the fractions to one another is controlled by varying the size of the plenum chamber 20 to control the velocity of the air passing through the chamber.

As is well known in the operation of cyclones, air and materials entrained in the air will enter tangentially near the top of the cyclone such that spiral or circular flow will occur within the cyclone. Thus, material entrained within the air stream wil be urged by centrifugal force toward the cylindrical wall and will then drop down into the tank 112.

At the bottom of the collecting tank 112 is a feed screw 26 by which the material collected therein is moved to the conveyor 28 for removal to a suitable storage area for subsequent use as a fuel or for other purposes.

It will be apparent from the foregoing that the drum 16 must have a very loose fit with the opening 128 in the front wall 130 of the plenum 20 so that the drum will be permitted both rotation and vertical adjustability without interference. However, such loose fit results in a considerable inrush of air through the space between the drum and plenum wall 130 when the fan 62 is being operated. This, of course, diminishes the air flow through the drum and thus affects the material classification procedure.

In order to reduce or eliminate this problem a sealing device 132 (FIG. 3) is mounted over the outer surface of the drum 16 adjacent its upper end and is shaped to substantially close a boxlike projection or seal housing 134 which is built onto the plenum wall 130 over the opening 128 therein.

Figure 3:
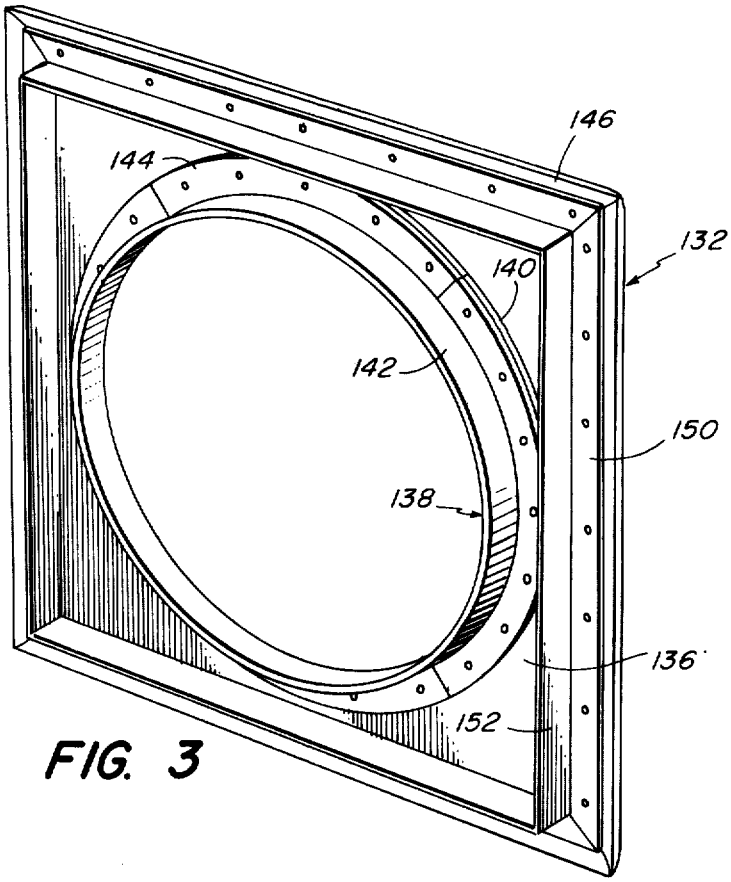
FIG. 3 is an enlarged isometric view of the seal embodying the invention.
Figure 4:
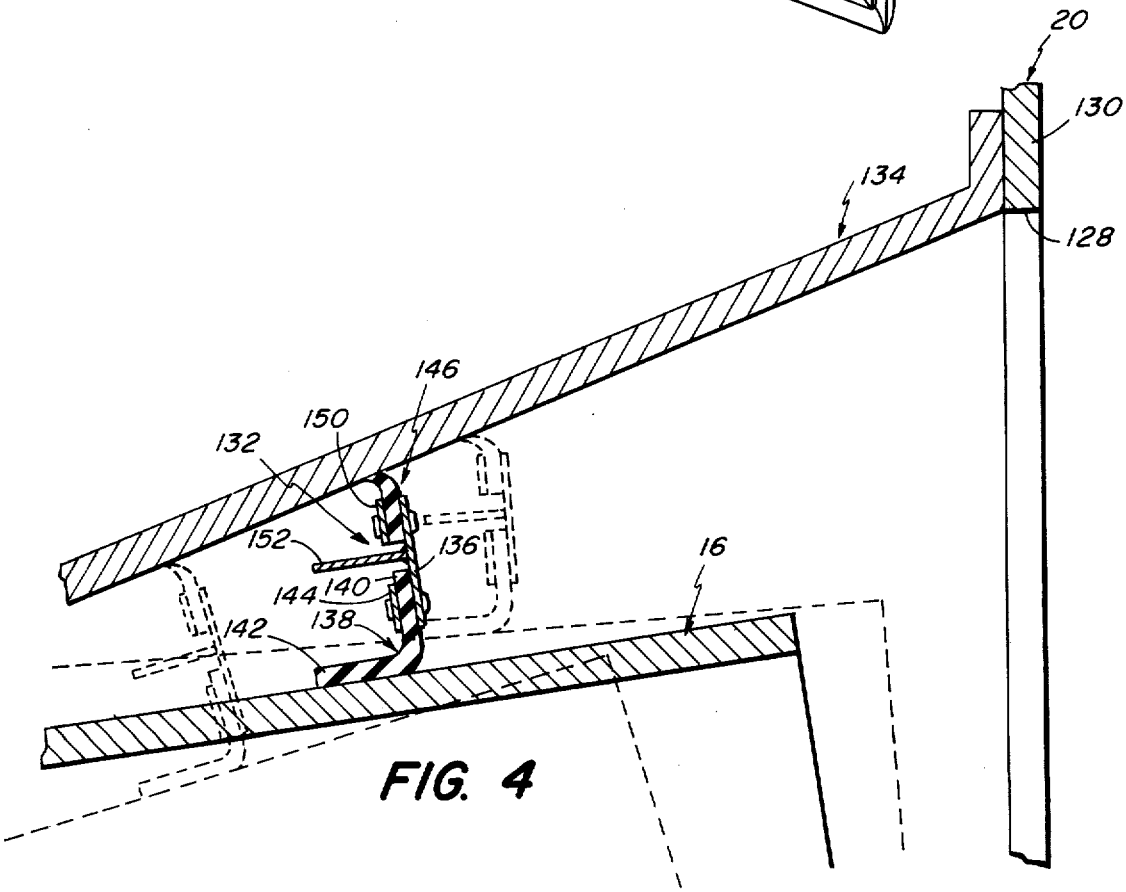
FIG. 4 is an enlarged fragmentary sectional view showing the top portion of the seal and its relation to the drum and plenum extension.

Referring particularly to FIGS. 3 and 4, the seal 132 comprises a rigid plate 136, preferably but not necessarily of square or rectangular shape, which is provided with a central opening of circular shape somewhat larger than the outer diameter of the drum 16. A flanged flexible ring 138 of material such as molded rubber is attached to the plate 136 by one flange 140 in encircling relation to the opening therein. The other flange 142 of the ring 138 encircles and rests upon the outer surface of the drum as shown best in FIG. 4 whereby as the drum rotates the flange 142 will continually remain in frictional engagement with the drum surface. Flange 140 may be firmly attached to the plate 136 as by the use of a bolted metal retaining ring 144.

Plate 136 also carries an outwardly extending flexible member 146 of molded rubber or the like which extends throughout the entire marginal area of the plate. Member 146 is bolted or otherwise secured to the plate 136 by a bolted flat metal retaining strip or strips 150. Flange 152 is attached to plate 136, extending in a direction away from plate 136 and toward the lower end of the drum for reasons to be apparent hereinafter.

The outer edge of member 146 is tapered or beveled and is flexibly engaged throughout its perimeter with the inner surface of the seal housing 134 on the plenum wall 130.

The seal 132 is mounted on the drum and is consequently movable with it whenever the drum is adjusted up or down. Since the member 146 is flexible, it will continually slide along and maintain engagement with the inner surfaces of the seal housing 134 during such up and down pivotal movement of the drum. This is illustrated by the dotted lines in FIG. 4.

To retain the seal 132 is proper position upon the drum and within the housing 134, there is provided, at each side of the drum, a connecting frame 148 which is mounted at its lower end on the base or platform 38. The frames each comprise a number of bars 149 which are connected directly or by plates 151 to the aforementioned flange 152 of the seal 132. Thus, when the platform 38 is moved up or down to adjust the angle of inclination of the drum 16, the connecting frame 148 which is fixed to the platform will consequently also move. Since the frame is connected to the seal 132 as described, this will cause the seal to move within the housing 134 and thus the seal will constantly be retained in proper functional relationship with both the drum and the seal housing. Such relationship does not interfere with the rotation and angular adjustment of the drum and, furthermore, prevents substantial amounts of air from being drawn into the plenum except through the drum, as is desired.

Accordingly, from the foregoing it will be apparent that all of the advantages and objectives of this invention have been achieved by the apparatus shown and described which provides directing a flow of air through a hollow rotational and pivotal member into a chamber without permitting flow of substantial amounts of air into the chamber from externally of the member.

It is to be understood, however, that various modifications and changes in the apparatus shown and described may be made by those skilled in the art without departing from the spirit of the invention as expressed in the accompanying claims. Therefore, all matter shown and described is to be interpreted as illustrative and not in a limiting sense.

What is claimed is:

1. Apparatus comprising an elongated hollow member rotatable about its longitudinal axis, a stationary enclosure having an opening therein, one end of said member being located adjacent said opening with the interior of the member being in communication with the interior of the enclosure, the member further being angularly adjustable about an axis adjacent said one end thereof, means for providing a flow of air through said member and enclosure, a hood mounted on said enclosure around the opening therein, said one end of the rotatable member projecting freely into said hood, and seal means disposed within the hood between the hood and said end of the rotatable member for preventing passage of substantial amounts of air therebetween while permitting rotation and angular movement of the member, said hood surrounding the adjacent end portion of said rotatable member, and said seal means comprising a flexible inner annulus encircling and frictionally engaging said rotatable member, and a flexible outer annulus in slidable engagement with the surrounding inner surface of the hood.

2. Apparatus as set forth in claim 1 wherein said seal means further comprises a rigid plate having an opening through which the rotatable member extends, said plate extending in a plane perpendicular to the outer circumference of the rotatable member, said flexible inner annulus is attached to the plate around said opening therein, and said flexible outer annulus is attached to and extends around the outer periphery of the plate and frictionally engages the inner surface of the hood.

3. Apparatus as set forth in claim 1 wherein said member is rotatably mounted on a base, which base is vertically adjustable about an axis adjacent said one end of the member to position the member at a desired angle of inclination, and said seal means is fixed to the base for movement therewith while being retained in positional relationship with the member.

4. Apparatus as set forth in claim 3 wherein said seal means further includes rigid connector portions, and connecting means is fixed to said base and is attached to said connector portions for supporting and moving said seal means in response to movement of the base.

* * * * *